US010390162B2

(12) United States Patent
Gaskell et al.

(10) Patent No.: US 10,390,162 B2
(45) Date of Patent: Aug. 20, 2019

(54) METHOD OF FORMING AN ACOUSTIC TRANSDUCER

(71) Applicant: THE ROYAL INSTITUTION FOR THE ADVANCEMENT OF LEARNING/MCGILL UNIVERSITY, Montreal (CA)

(72) Inventors: Peter Gaskell, Montreal (CA); Robert-Eric Gaskell, Montreal (CA); Thomas Szkopek, Outremont (CA); Jung Wook Hong, Montreal (CA)

(73) Assignee: THE ROYAL INSTITUTION FOR THE ADVANCEMENT OF LEARNING / MCGILL UNIVERSITY, Montreal (CA)

( * ) Notice: Subject to any disclaimer, the term of this patent is extended or adjusted under 35 U.S.C. 154(b) by 0 days.

(21) Appl. No.: 15/516,053

(22) PCT Filed: Oct. 6, 2015

(86) PCT No.: PCT/CA2015/000527
§ 371 (c)(1),
(2) Date: Mar. 31, 2017

(87) PCT Pub. No.: WO2016/054723
PCT Pub. Date: Apr. 14, 2016

(65) Prior Publication Data

US 2017/0251318 A1 Aug. 31, 2017

Related U.S. Application Data

(60) Provisional application No. 62/060,043, filed on Oct. 6, 2014.

(51) Int. Cl.
*H04R 31/00* (2006.01)
*H01B 1/04* (2006.01)
(Continued)

(52) U.S. Cl.
CPC ..... *H04R 31/003* (2013.01); *H01B 1/04* (2013.01); *H04R 7/04* (2013.01); *H04R 7/14* (2013.01);
(Continued)

(58) Field of Classification Search
CPC ... H01B 1/04; H04R 7/04; H04R 7/14; H04R 9/048; H04R 31/003
See application file for complete search history.

(56) References Cited

U.S. PATENT DOCUMENTS 8,275,156 B2 9/2012 Akino
8,275,157 B2 9/2012 Akino
(Continued)

FOREIGN PATENT DOCUMENTS

WO 2011142637 A2 11/2011
WO 2013035900 A1 3/2013
WO 2013049794 A1 4/2013

OTHER PUBLICATIONS

Tian et al. "Flexible and large-area sound-emitting device using reduced graphene oxide", IEEE 26Th International Conference on Micro Electro Mechanical Systems (MEMS), 2013, pp. 709-712, Taiwan.

(Continued)

*Primary Examiner* — Paul D Kim
(74) *Attorney, Agent, or Firm* — Norton Rose Fulbright Canada LLP; Alexandre Daoust

(57) ABSTRACT

The method can include depositing a graphene oxide containing material from solution to form a laminar nanostructure of graphene oxide paper, and assembling at least a portion of the graphene oxide paper as a diaphragm of the acoustic transducer. The acoustic transducer can be a magnetic induction based microphone, a diaphragm loudspeaker, or a magnetic induction based loudspeaker, for instance.

7 Claims, 8 Drawing Sheets

100 150

(51) Int. Cl.
*H04R 7/14* (2006.01)
*H04R 7/04* (2006.01)
*H04R 9/04* (2006.01)

(52) U.S. Cl.
CPC ..... *H04R 9/048* (2013.01); *H04R 2201/003* (2013.01); *H04R 2307/023* (2013.01)

(56) References Cited

U.S. PATENT DOCUMENTS 9,264,795 B2 * 2/2016 Pinkerton ..... H04R 1/283
9,264,796 B2 * 2/2016 Pinkerton ..... H04R 1/283
9,516,426 B2 * 12/2016 Pinkerton ..... H04R 7/02
9,516,428 B2 * 12/2016 Dehe ..... B81B 3/0018
2013/0256154 A1 * 10/2013 Peng ..... B82Y 30/00 205/780.5
2014/0205763 A1 * 7/2014 Lu ..... C01B 32/184 427/530
2014/0247954 A1 9/2014 Hall et al.
2014/0270271 A1 9/2014 Dehe et al.
2016/0014521 A1 * 1/2016 Kim ..... B06B 1/0292 381/398
2016/0295338 A1 * 10/2016 Lettow ..... H04R 31/003

OTHER PUBLICATIONS

Joung et al. "High yield fabrication of chemically reduced graphene oxide field effect transistors by dielectrophoresis", IOP Publishing, Nanotechnology, pp. 1-5, Mar. 26, 2010, UK & the USA.
Dikin et al., "Preparation and characterization of graphene oxide paper", Nature Publishing Group, vol. 448, Jul. 26, 2007, pp. 457-460, USA.
Vallés et al. "Flexible conductive graphene paper obtained by direct and gentle annealing of graphene oxide paper", Carbon 50 (2012) 835-844, Elsevier, Sep. 29, 2011.

* cited by examiner

850

800

860

METHOD OF FORMING AN ACOUSTIC TRANSDUCER

CROSS-REFERENCE TO RELATED APPLICATIONS

This patent application also claims the benefit of U.S. Provisional Patent Applications 62/060,043 filed Oct. 6, 2014 entitled "Graphene Oxide based Acoustic Transducer Methods and Devices", the entire contents of which are incorporated herein by reference.

FIELD OF THE INVENTION

This invention relates to acoustic transducers and more particularly to graphene oxide based acoustic transducers.

BACKGROUND OF THE INVENTION

A microphone, also known as a mic or mike, is an acoustic-to-electric transducer or sensor that converts sound within a medium, typically air, into an electrical signal. Microphones are used in many applications such as telephones, gaming consoles, hearing aids, public address systems, film and video production, live and recorded audio engineering, two-way radios, radio and television broadcasting, and in computers for recording voice, speech recognition, voice-over-IP (VoIP), and for non-acoustic purposes such as ultrasonic checking or knock sensors.

Most microphones today use electromagnetic induction (dynamic microphones), capacitance change (condenser microphones) or piezoelectricity (piezoelectric microphones) to produce an electrical signal from air pressure variations. Microphones also must be used typically in conjunction with a preamplifier before the signal can be amplified with an audio power amplifier for use and/or recording.

Dynamic microphones work via electromagnetic induction and are robust, relatively inexpensive and resistant to moisture. This, coupled with their potentially high gain before feedback, makes them ideal for on-stage use. The most common dynamic microphones today are moving-coil microphones that exploit a small movable induction coil, positioned in the magnetic field of a permanent magnet, which is attached to the diaphragm. When the diaphragm vibrates under an acoustic stimulus then the coil moves in the magnetic field, producing a varying current in the coil through electromagnetic induction. A single dynamic membrane does not respond linearly to all audio frequencies and accordingly some dynamic microphones exploit multiple membranes for the different parts of the audio spectrum and then combine the resulting signals. Combining the multiple signals correctly is difficult and designs that do this tend to be expensive whilst some other designs are more specifically aimed towards isolated parts of the audio spectrum.

Ribbon microphones exploit a thin, usually corrugated metal ribbon suspended in a magnetic field. The ribbon is electrically connected to the microphone's output, and its vibration within the magnetic field generates the electrical signal. Ribbon microphones are similar to moving coil microphones in the sense that both produce sound by means of magnetic induction. However, basic ribbon microphones detect sound in a bi-directional pattern because the ribbon, which is open to sound both front and back, responds to the pressure gradient rather than the sound pressure.

Ribbon microphones were once delicate, and expensive, but modern materials have made certain present-day ribbon microphones very durable and suitable to applications outside the once limiting studio environment. Ribbon microphones are prized for their ability to capture high-frequency detail, comparing very favorably with condenser microphones, which can often sound subjectively "aggressive" or "brittle" in the high end of the frequency spectrum. Due to their bidirectional pick-up pattern, ribbon microphones are often used in pairs to produce the Blumlein Pair recording array. In addition to the standard bidirectional pick-up pattern, ribbon microphones can also be configured by enclosing different portions of the ribbon in an acoustic trap or baffle, allowing cardioid, hypercardioid, omnidirectional, and variable polar patterns, for example, although these configurations are much less common.

A loudspeaker, also known as a speaker or loud-speaker, produces sound in response to an electrical signal input. The most common speaker used today is the dynamic speaker which operates on the same basic principle as a dynamic microphone, but in reverse, in order to produce sound from an electrical signal. When an alternating current electrical audio signal input is applied through the voice coil, a coil of wire suspended in a circular gap between the poles of a permanent magnet, the coil is forced to move rapidly back and forth due to Faraday's law of induction, which causes a paper cone attached to the coil to move back and forth, pushing on the air to create sound waves.

To adequately reproduce a wide range of frequencies, many loudspeaker systems employ more than one loudspeaker, particularly for higher sound pressure level or maximum accuracy. Individual loudspeaker are used to reproduce different frequency ranges. These loudspeakers are typically referred to as subwoofers (for very low frequencies); woofers (low frequencies); mid-range speakers (middle frequencies); tweeters (high frequencies); and sometimes supertweeters, optimized for the highest audible frequencies.

As with microphones a ribbon speaker employing a thin metal film ribbon suspended in a magnetic field offers a very good high frequency response due to the low mass of the ribbon and as such have tended to be employed in tweeters and supertweeters. An extension of ribbons, although strictly not true ribbon speakers, are planar magnetic speakers employing printed or embedded conductors on a flat diaphragm wherein the current flowing within the coil interacts with the magnetic field, which if appropriately designed yields a membrane moving without bending or wrinkling wherein the large percentage of the membrane surface experiencing the driving force reduces resonance issues in coil-driven flat diaphragms.

With portable multimedia players, portable gaming systems, smartphones, etc. the market for loudspeakers and microphones has expanded significantly over the past decade eclipsing the volumes from residential applications etc. In 2013 the global audiovisual headphone market was estimated at approximately $8 billion with nearly 300 million sets sold. Within this headphones with microphones were an emerging trend accounting for nearly 20% of global shipments and expected to grow to 40% in 2017. At the same time within portable applications low cost headphones such as in-ear "ear buds" have been losing significant market share to the traditional over-the-ear headphones and on-ear headphones primarily as the result of marketing and branding from companies such as Beats™, SkullCandy™. As such premium audiovisual (AV) equipment is now dominating a market where historically AV devices were merely necessary accessories.

Accordingly, it would be beneficial to leverage the technical performance achievable from ribbon microphones which currently reside primarily within recording studios into the broader global marketplace of AV equipment. Similarly it would be beneficial to leverage ribbon and/or planar loudspeaker designs into this broader global marketplace of AV equipment. It would be further beneficial for new materials to be established improving the mechanical strength of ribbon microphones and loudspeaker as well as reducing the material and implementation costs of such microphones and loudspeakers.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to address limitations within the prior art relating to acoustic transducers and more particularly to graphene oxide based acoustic transducers.

In accordance with an embodiment of the invention there is provided method of forming an acoustic transducer comprising:

depositing and processing a graphene containing material from solution to form a graphene containing film; and thermally processing the graphene containing film to adjust its electrical characteristics.

In accordance with an embodiment of the invention there is provided a method of forming an acoustic transducer comprising:

fabricating a first predetermined portion of a MEMS acoustic transducer using a silicon based MEMS manufacturing process; and fabricating a second predetermined portion of the MEMS acoustic transducer by depositing and processing a graphene containing material.

In accordance with an embodiment of the invention there is provided an acoustic transducer element comprising at least a graphene containing material.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
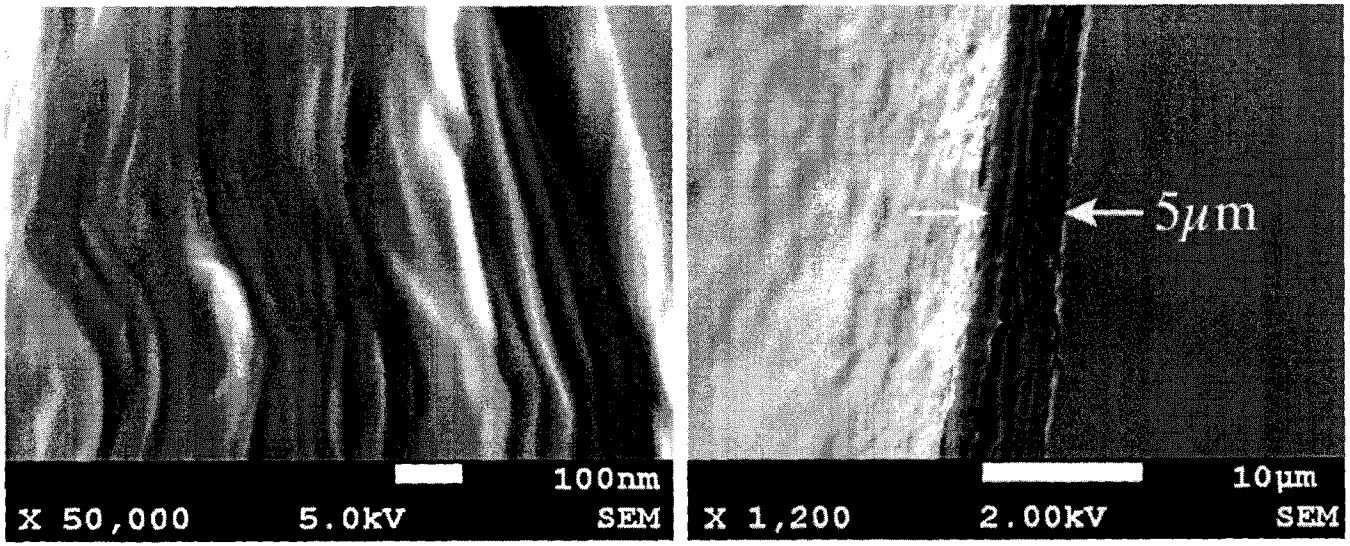
FIG. 1 depicts scanning electron micrograph and optical micrograph images depicting the laminar nano-structure of graphene oxide paper and it's structure after thermal reduction as produced according to embodiments of the invention.

The present invention is directed to acoustic transducers and more particularly to graphene oxide based acoustic transducers.

The ensuing description provides exemplary embodiment(s) only, and is not intended to limit the scope, applicability or configuration of the disclosure. Rather, the ensuing description of the exemplary embodiment(s) will provide those skilled in the art with an enabling description for implementing an exemplary embodiment. It being understood that various changes may be made in the function and arrangement of elements without departing from the spirit and scope as set forth in the appended claims.

A "portable electronic device" (PED) as used herein and throughout this disclosure, refers to a wireless device used for communications and other applications that requires a battery or other independent form of energy for power. This includes devices, but is not limited to, such as a cellular telephone, smartphone, personal digital assistant (PDA), portable computer, pager, portable multimedia player, portable gaming console, laptop computer, tablet computer, and an electronic reader.

A "fixed electronic device" (FED) as used herein and throughout this disclosure, refers to a wireless and/or wired device used for communications and other applications that requires connection to a fixed interface to obtain power. This includes, but is not limited to, a laptop computer, a personal computer, a computer server, a kiosk, a gaming console, a digital set-top box, an analog set-top box, an Internet enabled appliance, an Internet enabled television, and a multimedia player.

An "acoustic transducer" as used herein and throughout this disclosure, refers to a component, device, or element within an a component, device, or system converting electrical signals to acoustic signals which are propagated within a medium and/or converting acoustic signals propagating within a medium into electrical signals. Such acoustic transducers may include, but not be limited to, microphones and loudspeakers forming part of a PED, FED, wearable devices, and other devices such as headphones, for example.

A "user" as used herein may refer to, but is not limited to, an individual or group of individuals whose biometric data may be, but not limited to, monitored, acquired, stored, transmitted, processed and analysed either locally or remotely to the user wherein by their engagement with a service provider, third party provider, enterprise, social network, social media etc. via a dashboard, web service, website, software plug-in, software application, graphical user interface acquires, for example, electronic content. This includes, but is not limited to, private individuals, employees of organizations and/or enterprises, members of community organizations, members of charity organizations, men, women, children, teenagers, and animals. In its broadest sense the user may further include, but not be limited to, software systems, mechanical systems, robotic systems, android systems, etc. that may be characterised by incorporating an acoustic transducer.

A "wearable device" or "wearable sensor" relates to miniature electronic devices, electronic devices, electronic components, and electronic transducers that are worn by the user including those under, within, with or on top of clothing and are part of a broader general class of wearable technology which includes "wearable computers" which in contrast are directed to general or special purpose information technologies and media development. Such wearable devices and/or wearable sensors and/or transducers may include, but not be limited to, smartphones, smart watches, e-textiles, smart shirts, activity trackers, smart glasses, smart headgear, sensors, navigation systems, alarm systems, and medical testing and diagnosis devices.

1. Graphene

Graphene, a single layer of carbon atoms arranged in a hexagonal crystal lattice, was first isolated by A. Geim and K. Novoselov in 2004. The discovery of this stable 2D material led to research on its electrical properties; where unlike the other carbon crystal structures, diamond and graphite (an insulator and conductor respectively) graphene's electrical properties are tunable with an electric field. This property found in silicon which forms the basis of crucial building blocks of our modern technological era gave promise of faster, cheaper, and more efficient electronics using graphene and led to significant research into the fundamental properties of graphene and related materials. The measurement of the mechanical properties of graphene indicated that the intrinsic strength of graphene was 130,000 MPa, making it amongst the strongest materials ever measured and more than 25 times stronger than the strongest steel. The Young's modulus, a measure of stiffness, was reported to be 1TPa . Due to its stiffness and low density, the speed of sound in graphene is ~20,000 m/s, amongst the fastest of known materials.

1.1 Graphene Materials

The high strength and low mass of graphene materials makes them suitable to overcome some of the problems exhibited with aluminum ribbons used in ribbon transducers, and could find use in other transducer membranes as well. Zhou demonstrated in-ear electrostatic speakers using 35 layer, 3.5 mm diameter graphene membranes with excellent audio performance. Whilst this example shows the performance attainable with pure graphene membranes, the method of production requires high temperature chemical vapor deposition techniques and a sacrificial high purity nickel film which may not prove cost effective, especially when considering very high volume consumer applications.

Within the embodiments of the invention other methods for producing large-scale membranes from precursor materials that are less expensive to produce, allow for larger sizes and complex forms are presented whilst maintaining the benefits of pure graphene. Amongst the simplest precursors to work with for these manufacturing methods according to embodiments of the invention is Graphene Oxide (GO) which is an oxidized form of graphene containing up to 40% oxygen by weight. GO can be produced by exfoliating and oxidizing small graphene flakes, typically 10-20 μm in dimensions, which are produced from bulk graphite using strong acids and ultrasonic agitation. The oxygen groups attached on the surface of the flakes impart a surface charge which allows easy dispersion in polar solvents like water, but makes the GO an insulator, with a typical resistivity of a square GO film on the order of 10MΩ·m. However, GO does retain much of the high strength of the hexagonal graphene lattice due to the in-plane covalent carbon bonds, though the mechanical properties of individual flakes of GO are not quite as high in terms of strength compared against pure graphene as the defects induced by the oxidation reduce the number of covalent carbon bonds in the material.

GO has a remarkable ability to self-assemble into laminar films referred to as GO paper, see Dikin et al in "Preparation and Characterization of Graphene Oxide Paper" (Nature 448, pp. 457). GO paper offers a material that is flexible and durable with physical dimensions and thickness that can be easily varied. Referring to FIG. 1 in first image 100 there is depicted the laminar structure of GO paper in a micrograph taken with a scanning electron microscope. The mechanical strength of GO paper is derived from a combination of the mechanical properties of the GO flakes themselves and the interlayer hydrogen bonding between the stacked flakes. The properties of GO papers can be further tuned by using different molecules to "glue" the sheets together such as poly (vinyl alcohol). Amongst the techniques for forming GO paper sheets are from an aqueous suspension of GO through vacuum filtration onto an inorganic filter or through deposition and passive evaporation on a suitable substrate.

While GO paper is highly insulating due to the high oxygen content of the material, the oxygen can be removed through a process known as reduction. Amongst the techniques for producing reduced GO (rGO) paper the simplest is thermal reduction by exposing the GO paper to a high temperature. For example, above 270° C. the majority of the oxygen is removed. Second image 150 in FIG. 1 shows a micrograph of the cross-section of an rGO paper film. Heating to higher temperatures in an inert atmosphere further removes oxygen. Alternatively, chemical reduction by strong reducing agents such as hydrazine or hydroiodic acid, for example, can produce low oxygen content reduced GO films. The resistance of the rGO films depends on the reduction method but the resistivity of rGO films can be as low as 30 μΩ·m.

1.2. Ribbon Transducer Applications

To test GO and rGO paper films as acoustical transducer materials, a ribbon microphone was employed by the inventors as an optimal testing platform where the benefits of high strength and low mass are apparent. Ribbon microphones are one of the oldest audio technologies still in use today and are elegantly simple systems where a lightweight, conductive ribbon is suspended in a magnetic field such that movement of the ribbon within the magnetic field due to pressure gradient from a sound wave induces an electrical current. The velocity, and therefore the high frequency response, of this system is mass-controlled by the weight of the ribbon. As the ribbon itself has a low resistance the output impedance of a ribbon microphone is generally determined by the resistance of the ribbon reflected across a step-up transformer at the output of the microphone.

For a material to be successfully used in a ribbon transducer it must have very low mass and very high conductivity. As a result ribbons have historically been constructed from high-purity aluminum, and even with the low density of aluminum (2.7 g/cm$^2$) ribbons must still be made exceedingly thin thereby leading to issues over mechanical integrity. The strength of aluminum is relatively high, 60 MPa ultimate strength, but there is a tradeoff between mechanical strength and mass such that in practice aluminum ribbons are very fragile and must be handled and installed with care. As such historically the applications of ribbon microphones have been limited due to this fragile nature of the very thin aluminum used in most models of these transducers.

In addition to the problems with breakage, the ductility of aluminum is high and plastic deformation may occur where high sound pressure levels are present. Deformation of the ribbon results in a permanent change of the resonant frequency of the ribbon assembly and a weakening of the aluminum material. Accordingly, damaged ribbons require replacement or retuning and this regular maintenance can add significantly to the cost of ownership of a ribbon microphone. Accordingly, the inventors have established that the high strength and low mass of graphene materials, e.g. GO paper and rGO paper, make them suitable to overcome these drawbacks against the materials such as aluminum commonly used in ribbon transducers.

2. Design and Production of Graphene Oxide Ribbons

Within the following descriptions of embodiments of the invention for GO paper ribbon acoustic transducers the prototype ribbon materials were formed such that their dimensions and thickness were kept as similar as possible to a commercial aluminum ribbon so the materials could be judged on mass and mechanical properties. The first material was an aluminum coated GO ribbon. A very thin coating of aluminum was added to make the insulating GO conductive whilst not increasing the mass significantly. The second material was a thermally reduced rGO ribbon with a thin aluminum coating added to both sides to improve the conductivity.

2.1 GO Paper Synthesis

Figure 2:
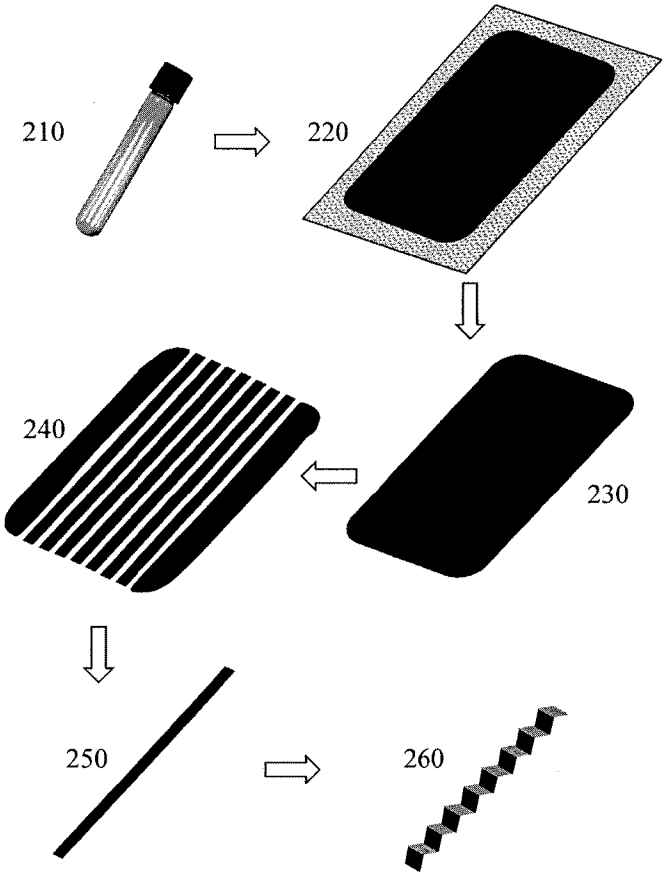
FIG. 2 depicts schematically the production of graphene oxide ribbons according to an embodiment of the invention.

The synthesis of GO and rGO paper films began with a suspension of single layer GO flakes in water. The steps for the simple evaporation production method employed within the ribbons reported here are depicted in FIG. 2. As such:

Step 210—preparation of GO flake suspension in water;

Step 220—coating a polymer substrate with the GO suspension and placed desiccation to dry the film wherein the water evaporates and the GO flakes self-assemble into laminar structures;

Step 230—the GO film is carefully peeled from the polymer substrate;

Step 240—the GO film is cut into strips;

Step 250—(optional) the GO ribbon is placed into an oven at 280° C. in order to produce the rGO ribbon; and Step 260—the GO (or rGO) ribbon is crimped.

Figure 3:
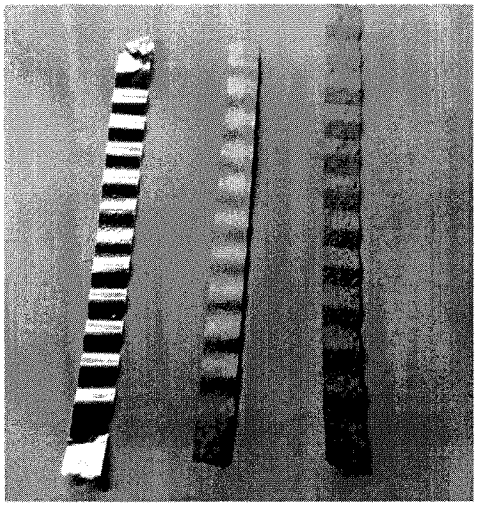
FIG. 3 depicts aluminum coated graphene oxide ribbons as manufactured and employed according to embodiments of the invention.

The thickness of the final GO film can be controlled by the quantity of GO deposited. As the conductivity of the ribbon is an important factor for ribbon transducer sensitivity then in order to make the GO ribbon conductive and improve the conductivity of the rGO ribbon, 100 nm of aluminum was deposited on each ribbon by electron beam evaporation. While other methods can be used for aluminum deposition, including the more common plasma sputtering, evaporation is a relatively gentler process and thickness can be controlled to a higher accuracy. Optionally, other high conductivity materials, including for example other metals such as gold or silver can be deposited. However, for these experiments for its aluminum was selected for its tradeoff between mass and conductivity. Ribbons were pressed in a corrugated form for several hours to produce the crimping. Photographs of the crimped ribbons employed within the experiments are depicted in FIG. 3.

3. Experimental Results

Comparative measurements of the physical, mechanical and acoustic characteristics of GO and rGO ribbons were made and contrasted with a traditional aluminum ribbon according to the prior art. Each ribbon was also employed within a microphone application and, by driving the system with an electric current, functioning speakers were also demonstrated. The three ribbon types displayed significant differences in strength, plasticity and conductivity. Differences in output level were also significant, however, the relative frequency response of the different ribbons was consistent.

3.1. Physical Properties

The physical properties of the three ribbons compared, namely the prior art aluminum and the GO/rGO ribbons according to embodiments of the invention, are summarised in Table 1. The rGO ribbon was the lightest material, weighing 0.74 mg, with the lowest density (1.2 5g/cm$^3$), and the thickness was comparable to the aluminum ribbon, 3 μm. The thickness of the GO ribbon was 5 μm, and it weighed more (1.81 mg) and had a comparable density to the aluminum ribbon (2.2 g/cm$^3$). The ribbon resistance was the most significant difference. The resistivity of the GO ribbon was measured to be 15.5 μΩ·m, which is significantly higher than the pure aluminum ribbon at 0.054 μΩ·m. However, for the rGO ribbons with each side was deposited with 100 nm of aluminum bringing the resistivity of the sample down to 1.75 μΩ·m.

TABLE 1

Measured Material Properties of Ribbons Tested

| | Aluminum | Reduced Graphene Oxide | Graphene Oxide |
|---|---|---|---|
| Thickness (μm) | 2.5 | 3.0 | 5.0 |
| Weight (mg) | 1.10 | 0.74 | 1.81 |
| Density (g/cm$^3$) | 2.4 | 1.25 | 2.2 |
| Aluminum Thickness (nm) | 2500 | 200 | 100 |
| Resistance (Ω) | 0.3 | 8 | 41 |
| Resistivity (μΩ · m) | 0.054 | 1.750 | 15.500 |

3.2 Mechanical Testing

Figure 4:
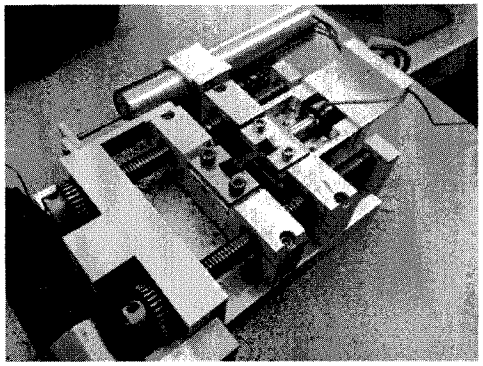
FIG. 4 depicts mechanical testing apparatus for measuring the strength and elastic modulus of materials of ribbons as manufactured according to embodiments of the invention.
Figure 5:
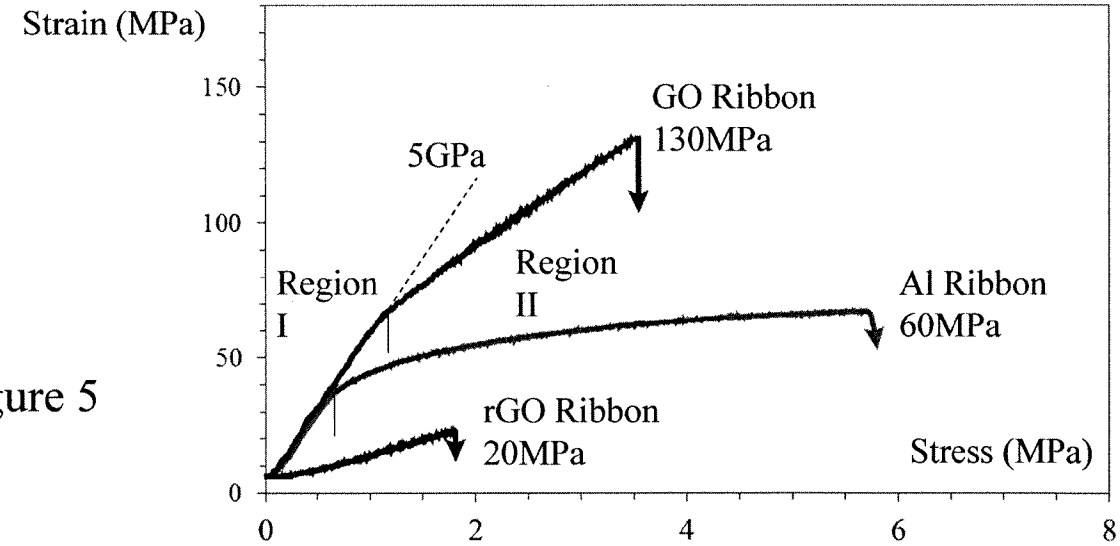
FIG. 5 depicts stress strain curve for the graphene oxide ribbons and aluminum oxide coated graphene oxide ribbons according to embodiments of the invention.

Tensile strength tests allow the determination of the force required to stretch and break a thin ribbon, as well as the elasticity of a sample. From these tests, the strength of a material as well as the Young's Modulus, the slope of the strain curve and a measure of the stiffness of a material, can be determined. The strength of GO produced with the facile evaporation method was measured using the setup shown in FIG. 4 as being 130 MPa at 3.5% elongation as evident from FIG. 5. A piece of 2.5 μm pure aluminum ribbon from a commercial ribbon microphone was also measured using the setup. The graph in FIG. 5 shows the stress strain curve for both the aluminum and GO samples as well as a sample of rGO. The aluminum sample has a very narrow region of elastic elongation (Region I), and then due to the malleability of the materials enters an extended region of plastic deformation (Region II). The mechanical tests show that the GO material is stronger than aluminum and can handle significantly more force without deforming and subsequently detuning. The rGO sample is much weaker than the other materials with a strength of 20 MPa , but does not deform before breaking.

3.3. Microphone Measurements

Figure 6:
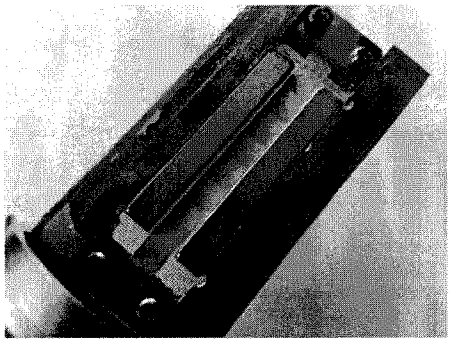
FIG. 6 depicts an image of a ribbon microphone motor with a crimped, aluminum coated reduced graphene oxide ribbon according to an embodiment of the invention installed.

Ribbons were installed into an assembly with a 5 mm gap between two 30 mm neodymium bar magnets as depicted in FIG. 6. The length of the suspended portion of each ribbon was 36 mm. The resonant frequency was tested by driving the ribbon with a low frequency AC current and measuring the increase in the potential across it. For all ribbons the resonant frequency was below 20Hz. A wire mesh blast-shield was placed on both faces of the motor assembly before testing.

Figure 7:
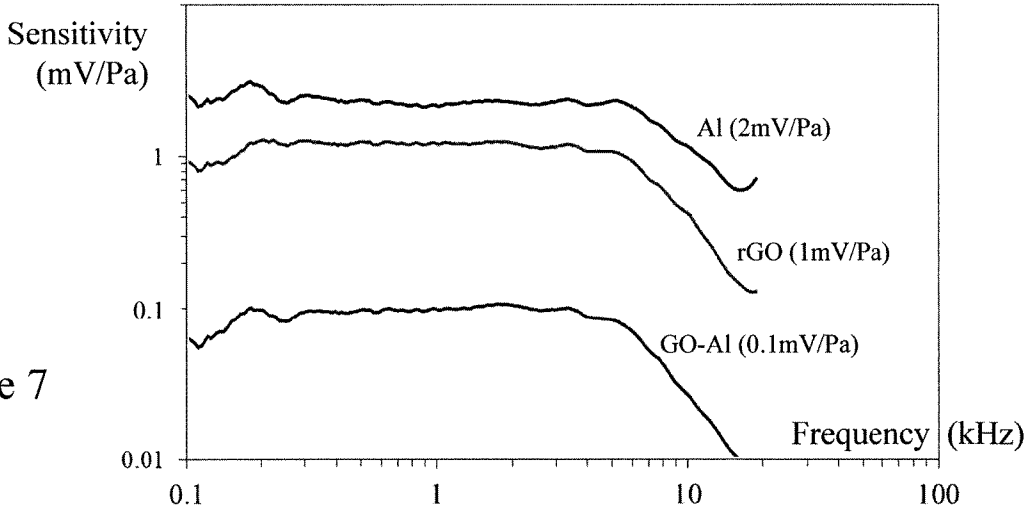
FIG. 7 depicts a plot of sensitivity versus frequency of graphene oxide ribbons according to embodiments of the invention.

The measured sensitivity from 100 Hz-20 kHz ($24^{th}$ octave moving average) of the test ribbons is shown in FIG. 7. Data below 100 Hz was unreliable because of the setup used and has been removed from the plotted results. The relative frequency response of all the ribbons is largely the same, as evident in FIG. 7, and is likely dominated by the transformer frequency response. The aluminum ribbon has a mid-band sensitivity of approximately 2 mV/Pa. The rGO ribbon has a comparable, but slightly reduced, sensitivity of approximately 1 m V/Pa. The sensitivity of the GO ribbon was far below that of the other two at approximately 0.1 mV/Pa. This is likely due to the high resistance of the ribbon. The inventors from the measurements and results to date together with published electrical conductivity data for graphene indicate that optimizations to the materials should produce graphene oxide based ribbons with higher sensitivities than that of a pure aluminum ribbon whilst maintaining the increased mechanical properties.

4. Diaphragm Loudspeakers

As with ribbon microphones diaphragm speakers require a diaphragm with low inertia and fast response for good frequency response. This again favours a diaphragm with a low total mass. Human perception of wideband features such as acoustic transients requires a wide frequency response of the diaphragm, which in turn requires a light, rigid, damped structure. At the same time within a diaphragm the quality of sound production is reduced by a phenomenon denoted as "speaker break-up" which arises from mechanical resonances within the diaphragm arising from standing acoustic waves travelling through the diaphragm itself. These can be suppressed by increasing the frequency of the mechanical resonances, which favours diaphragm materials with an elevated acoustic velocity.

A figure of merit (FOM) that takes the above factors into account is given by Equation (1) which is the ratio of the speed of sound within the material divided by the material's density. As the speed of sound in a material is given by Equation (2) then combining these leads to Equation (3) wherein $v_s$ is the speed of sound, E is the Young's modulus, and ρ is the mass density of the material.

$$FOM = (v_s/\rho) \tag{1}$$

$$v_s = \left(\frac{E}{\rho}\right)^{\frac{1}{2}} \tag{2}$$

$$FOM = \left(\frac{E}{\rho^3}\right)^{\frac{3}{2}} \tag{3}$$

Referring to Table 2 lists the material properties for a range of common materials and the resulting FOMs for these common materials. Based upon these beryllium has the highest FOM thus far with CVD diamond second. Based upon the material properties of graphite then a graphite diaphragm would have a FOM=6.5-9.5·$m^4$/kgs wherein the FOM for graphene oxide is expected to be similar yielding loudspeaker diaphragms without "speaker break-up" yet also with a low total mass.

Figure 8:
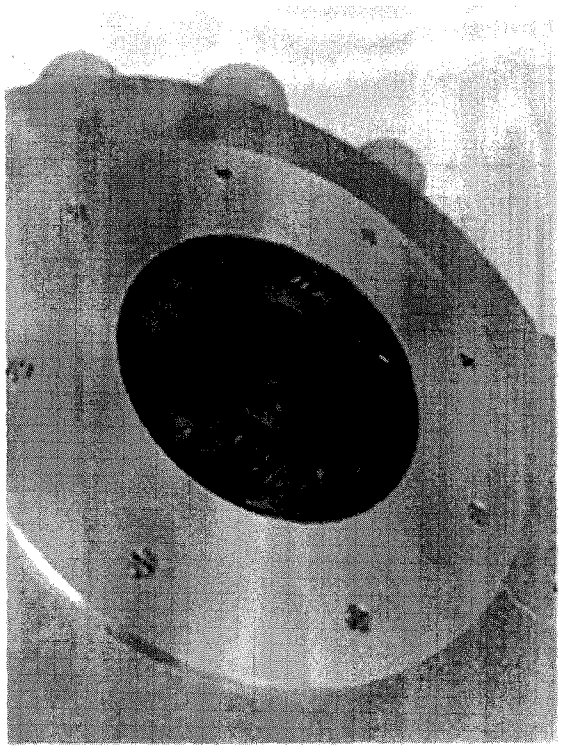
FIG. 8 depicts exemplary loudspeakers for headphones according to an embodiment of the invention.
Figure 8:
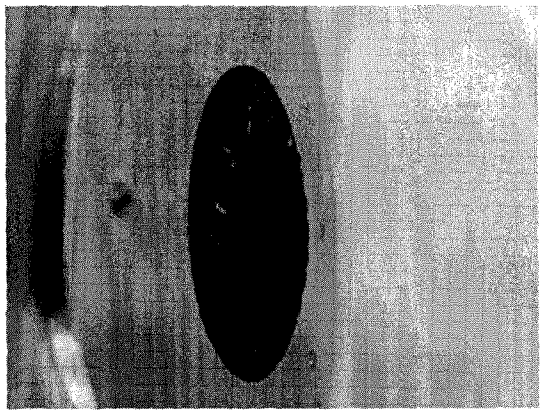
Figure 8:
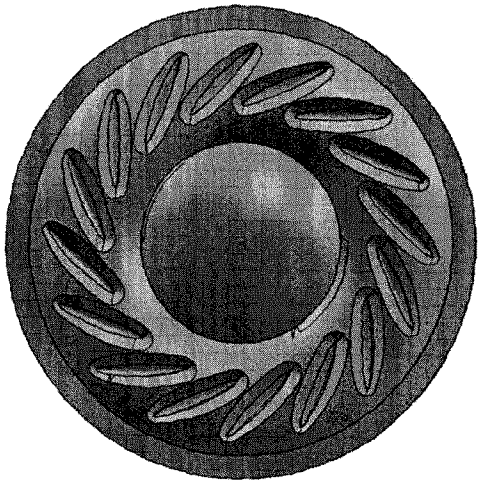

Referring to FIG. 8 there are depicted first and second optical micrographs 800 and 850 respectively for an rGO diaphragm formed by "crimping" a rGO film thereby yielding a shaped diaphragm according to the design depicted in schematic 860. Such shaping may, for example, be beneficial in implementing loudspeakers, such as tweeter loudspeakers wherein larger diaphragms, for high power output, have narrow radiating patterns. The "crimping" may be achieved by numerous means, including but not limited to the use of solid molds between which the rGO material is placed and pressure applied, the application of high humidity conditions, water vapour or steam prior to or during the crimping process to assist in crimping, the application of mechanical pressure with flexible molds, or other means with similar effect.

TABLE 2

Common Material Properties and Figures of Merit for Acoustic Transducers

| Property | Beryllium | Beryllia | Aluminum | Alumina | CVD Diamond |
|---|---|---|---|---|---|
| Density ($kg/m^3$) | 1,840 | 2,850 | 2,700 | 3,960 | 3,515 |
| Young's Modulus ($\times 10^9$) | 303 | 350 | 68 | 370 | 1050 |
| Speed of Sound (m/s) | 12,830 | 11,000 | 5,020 | 9,700 | 17,300 |
| Tensile Strength ($\times 10^6$ Pa) | 240 | 220 | 90 | 300 | 750 |
| Poisson's Ratio | 0.07-0.18 | 0.26 | 0.33 | 0.22 | 0.10 |
| Thermal Conductivity (W/m/K) | 216 | 285 | 210 | 30 | 1,800 |
| Electrical Conductivity ($\times 10^7$ 1/Ωm) | 2.3 | ~0 | 3.7 | ~0 | ~0 |
| Figure of Merit ($m^4$/kg/s) | 6.97 | 3.86 | 1.86 | 2.45 | 4.92 |

Figure 9A:
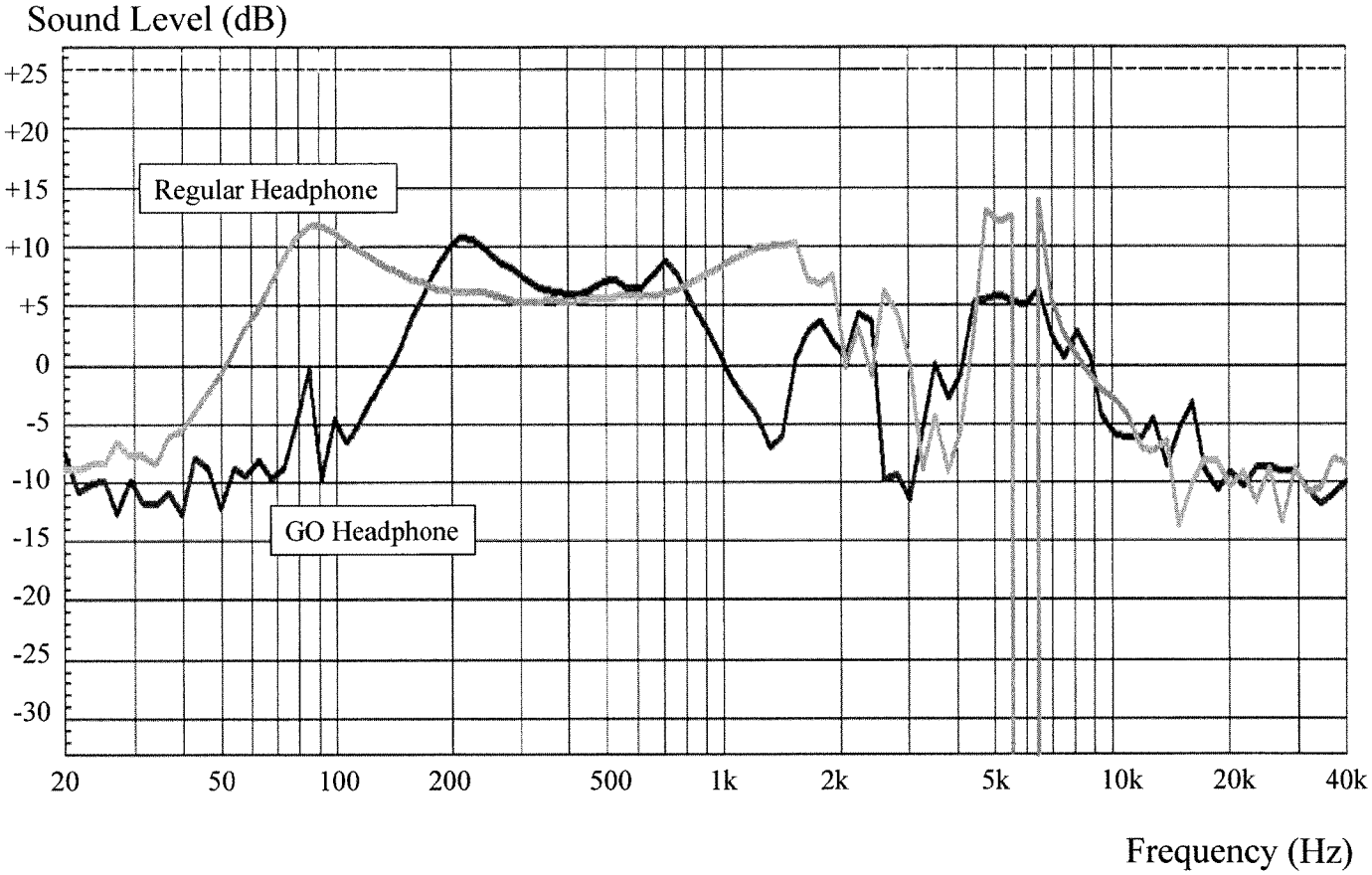
FIGS. 9A and 9B depict experimental results comparing flat GO diaphragm loudspeakers with prior art flat and shaped Mylar diaphragms respectively.
Figure 9B:
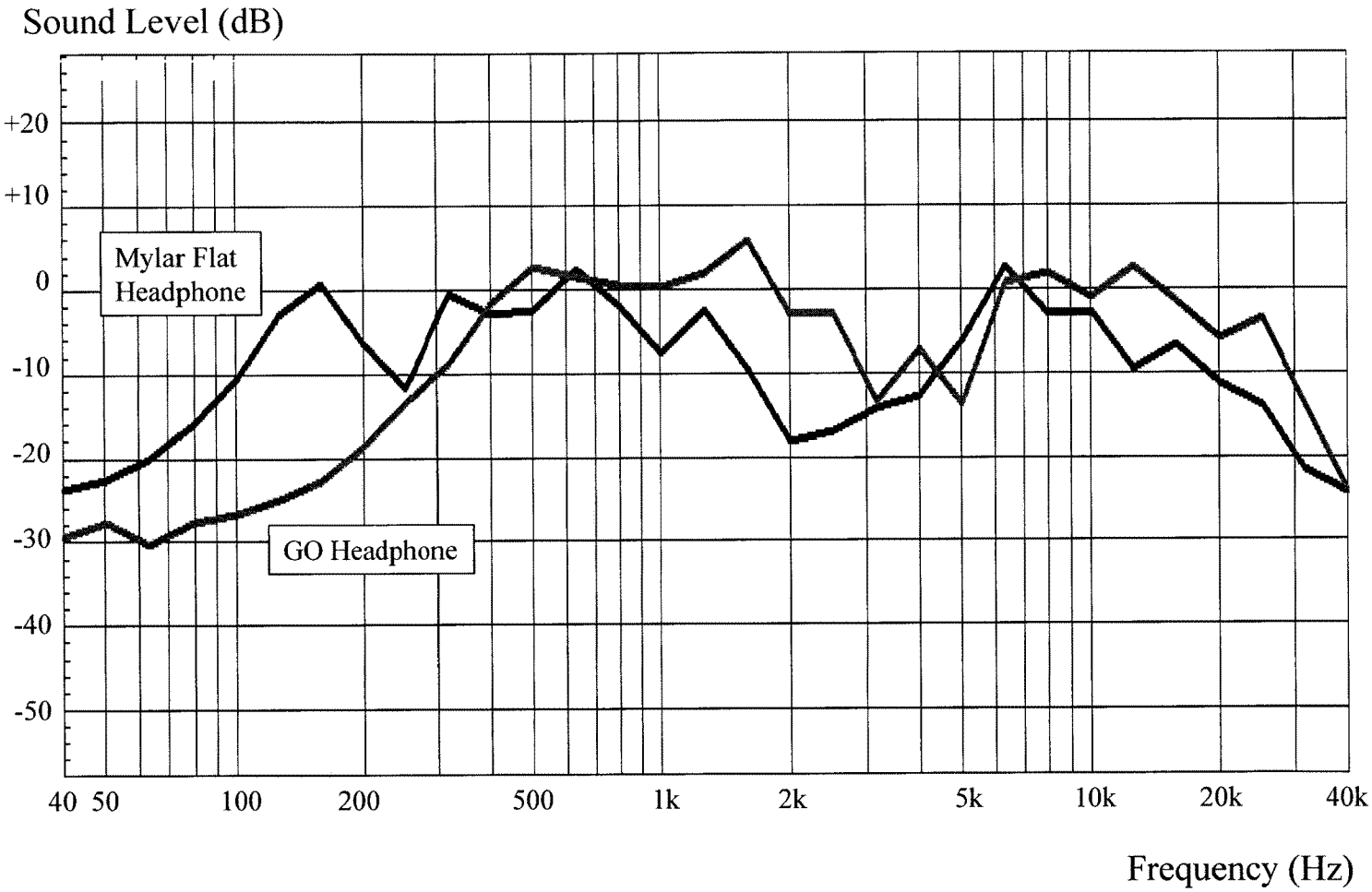
Figure 9C:
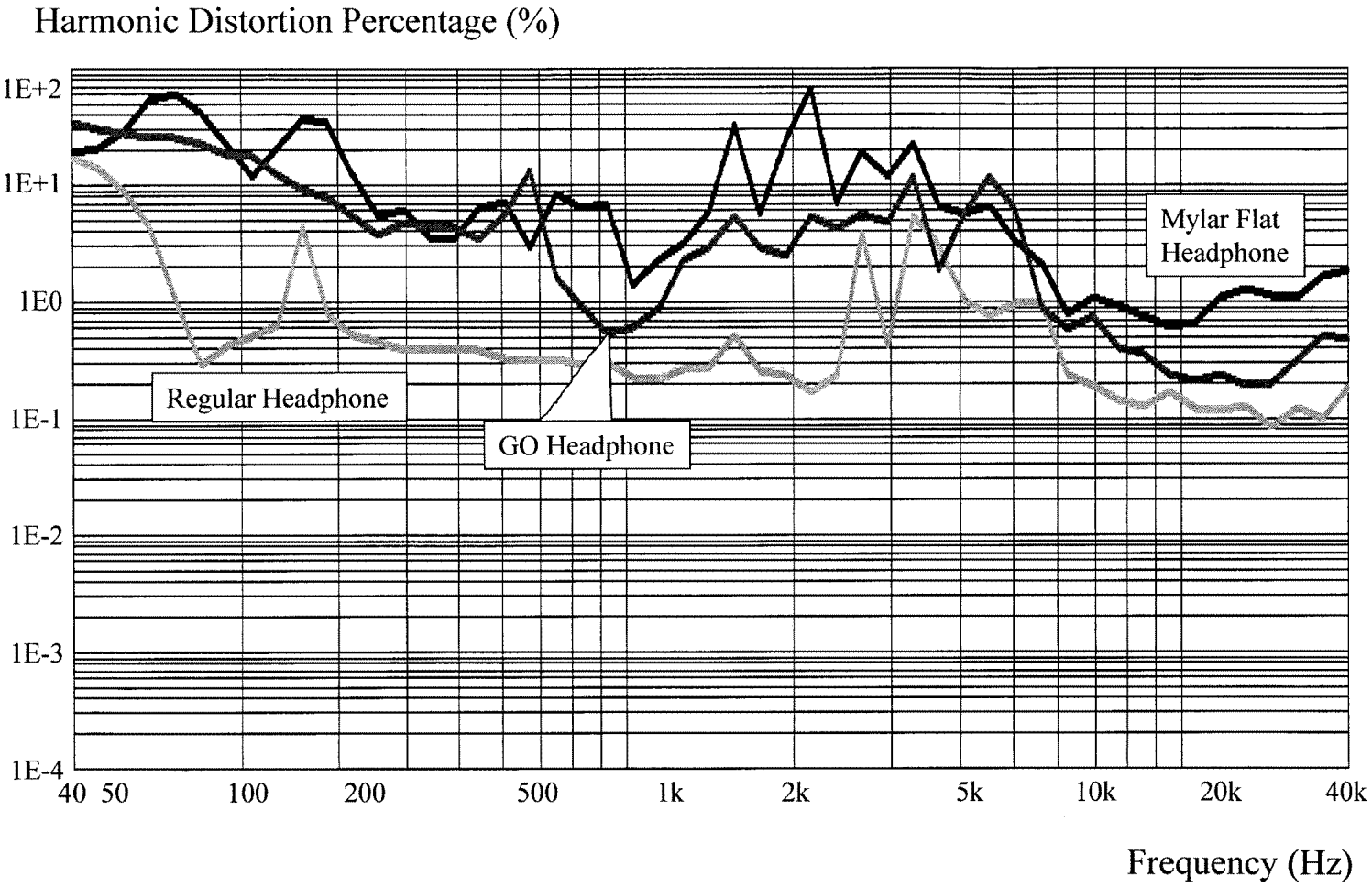
FIG. 9C depicts experimental results comparing flat GO diaphragm loudspeakers with prior art flat and shaped Mylar diaphragms.

Now referring to FIGS. 9A to 9B there are depicted frequency responses for flat GO diaphragms compared to prior art Mylar based loudspeakers and flat Mylar loudspeakers respectively. The ideal frequency response for a loudspeaker in comparison would be a passband with flat frequency response over approximately 20 Hz to 10 kHz. Now referring to FIG. 9C the harmonic distortion of the prior art paper and Mylar loudspeakers is presented compared to that of the GO diaphragms. These measurements being obtained by assembling the diaphragm loudspeakers into headphones and measuring their performance with a test dummy head with high sensitivity microphones within the ear channels.

Overall the GO diaphragm is capable of producing a better sound quality when compared to the Mylar diaphragm due to the overall lower distortion level as well having a flatter frequency response and higher SPL. This arises as within these initial GO diaphragms have reduced low frequency performance than the Mylar diaphragms their harmonic distortion is improved yielding better sound production. However, compared to a prior art shaped standard Mylar shaped diaphragm the GO diaphragm does not perform as well and is impacted by the lower distortion of the shaped Mylar diaphragm. However, it is expected that the molding of the GO film to the acoustical shaped diaphragm depicted in FIG. 8 with a dust cone and grooves would lower the distortion as evident from the comparison of a flat Mylar diaphragm to the shaped Mylar diaphragm.

5. Comments

As evident from the results depicted supra microphone ribbons that are lighter, stronger ribbons with reduced plastic deformation is a major advantage of graphene-based materials according to embodiments of the invention over pure aluminum ribbons. The effective density of both the coated GO and rGO ribbons is lower than the density of aluminum. The rGO ribbon had 33% less mass than the aluminum ribbon. While the GO ribbon had 66% more than the aluminum ribbon, the GO ribbon tested was twice as thick as the aluminum ribbon.

Accordingly, it is possible to create thinner samples through appropriate optimization of the graphene oxide. The mechanical strength of GO suggests it could easily support ribbons with dimensions half as thin and half as light as aluminum and still be stronger. It is also possible that the strength could be improved by engineering the nature of the interlayer bonding with a polymer binder.

The anomalous resistance of the 100 nm aluminum deposited on the surface of the GO may be due to the deposited aluminum delaminating, potentially creating cracks and discontinuities in the aluminum layer. The delaminating of the aluminum layer on GO would, absent a corrective action, may make it difficult to install the ribbon more than once. However, it would be evident that alternate manufacturing techniques, process flows, metallizations, etc. may allow for improve mechanical/electrical characteristics of the GO/rGO film with metallization including, but not limited, metallization formation post-ribbon separation and/or shaping to the desired profile.

The mechanical strength of the rGO ribbons is lower than that of the other materials. It is expected that adjustments to the reduction regimen used may yield stronger rGO films with yield strength surpassing that of GO and with lower resistivity. A stronger, more conductive, rGO film would require less aluminum mass be added to the already lower mass of the rGO ribbon.

For both the rGO and GO, the sensitivity of the microphone is dominated by the resistance of the ribbon. Modifications to the design of the ribbon, the formation of the graphene oxide film, the reduction of the graphene oxide, etc. should reduce the resistance. It would also be apparent that other aspects of the formation of the GO and rGO films may yield lower resistance ribbons and/or diaphragms.

It would be evident that ribbon microphones and diaphragm loudspeakers according to embodiments of the invention may also allow for microphones and/or loudspeakers operating at higher frequencies, e.g. above the typical 20 kHz human hearing range to 30 kHz, 80 kHz, 100 kHz, and beyond within the low frequency ultrasound region. Such microphones and loudspeakers may be employed in applications including, but not limited to, non-contact sensors, motion sensors, flow measurement, non-destructive testing, ultrasonic range finding, ultrasonic identification, human medicine, veterinary medicine, biomedical applications, material processing, and sonochemistry.

It would be evident to one of skill in the art that ribbon microphones and diaphragm loudspeakers according to embodiments of the invention may be employed within a wide range of electronic devices including, for example, PEDs, FEDs, and wearable devices.

It would be evident to one of skill in the art that other processing and manufacturing techniques may be employed to form acoustic transducer elements according to embodiments of the invention, e.g. chemical reduction and pressure and temperature reduction.

It would be further evident to one of skill in the art that, optionally, other graphene containing compounds may be employed as precursors with other processes and reduction techniques to yield graphene rich films. Similarly, it would evident to one of skill in the art that the graphene may, optionally, be exploited directly such as through graphene loading a polymeric matrix. Such a polymeric matrix may, for example, include an epoxy resin resulting in strengthened GO films, increased Young's Modulus and a decreased mass density.

It would be evident to one of skill in the art that, optionally, GO and/or rGO films and/or other graphene based films may be employed in conjunction with other materials in the formation of the ribbon membrane.

It would be evident to one of skill in the art that, optionally, rGO films in the form of ribbons and/or diaphragms may form part of a microelectromechanical system according to embodiments of the invention wherein the low temperature deposition and processing of the GO films to form the rGO oxide allows them to be compatible with processing of MEMS structures that are compatible with CMOS silicon circuits allowing post-CMOS manufacture of the MEMS structures wherein the silicon or other material MEMS cantilever is replaced with a rGO based film. Optionally, such a MEMS device may exploit a combination of rGO together with a material such as a thin silicon carbide (SiC), silicon nitride, or silicon oxide structural layer. The rGO film may be deposited during the MEMS manufacturing sequence and patterned, for example, during a subsequent intermediate processing step or through a final release processing step for the MEMS.

It would be evident to one of skill in the art that, optionally, the graphene films may be augmented by dispersal of other conductive elements including, for example, carbon nanotubes, multi-walled carbon nanotubes, and other fullerenes.

It would be evident to one of skill in the art that, optionally, the GO and/or rGO ribbon and/or diaphragm may be crimped laterally, may be crimped longitudinally, or may be crimped in first predetermined regions longitudinally and in second predetermined regions laterally, see for example Akino et al in U.S. Pat. No. 8,275,157 entitles "Ribbon Microphone and Ribbon Microphone Unit." It would be evident that more complex crimping patterns may be employed for ribbons and/or diaphragms. It would be evident that, optionally, the number of crimps per unit length and/or the height of the crimps may be varied within predetermined regions of the ribbon and/or diaphragm. It would be further evident that ribbon and diaphragm transducer elements may be formed simultaneously within a graphene containing film through a mechanical distortion process, e.g. crimping.

It would be evident to one of skill in the art that, optionally, the GO and/or rGO ribbon and/or diaphragm may be shaped according to a geometric shape, e.g. rectangular, square, circular, polygonal or that alternatively it may be shaped irregularly. Optionally, the design may be determined in dependence upon a desired frequency response or to suppress or shift resonances to outside regions of desired resonance free operation.

It would be evident to one of skill in the art that, optionally, the GO and/or rGO ribbons may be mounted within a fixed mounting or an adjustable mounting, see for example Akino et al in U.S. Pat. No. 8,275,156 entitled "Ribbon Microphone and Ribbon Microphone Unit" as well as others known within the art.

Accordingly, it would be evident to one of skill in the art that embodiments of the invention provide for methods of forming an element forming part of an acoustic transducer formed through depositing and processing a graphene containing material. Optionally, the depositing and processing of the graphene containing material may be through a solution based process to form an initial graphene containing film which is then thermally processed to yield the graphene containing film and that the thermal processing may be employed to adjust its electrical characteristics.

It would be evident to one of skill in the art that embodiments of the invention provide for acoustic transducers for use within magnetic induction based loudspeakers wherein the transducer is formed from a process comprising depositing and processing a graphene containing material.

In accordance with an embodiment of the invention there is provided a method of simultaneously forming ribbon and diaphragm acoustic transducer elements comprising forming a graphene containing film and subjecting the graphene containing film to a predetermined mechanical distortion process.

It would be evident to one of skill in the art that embodiments of the invention provide for acoustic transducers wherein the transducers are formed from a process comprising depositing and processing a graphene containing material and that ribbon and diaphragm acoustic transducer elements may be simultaneously fabricated.

It would be evident to one of skill in the art that embodiments of the invention provide for devices and methods of providing devices combining GO films as part of acoustic transducers employing MEMS elements. Accordingly, a first predetermined portion of a MEMS acoustic transducer may be manufactured using a silicon based MEMS manufacturing process whilst a second predetermined portion of the acoustic transducer is formed by depositing and processing a graphene containing material from solution to form a graphene containing film and then thermally processing the graphene containing film to adjust its electrical characteristics.

Specific details are given in the above description to provide a thorough understanding of the embodiments. However, it is understood that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process that is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A method of forming an acoustic transducer comprising:

depositing a graphene oxide containing material from solution to form a laminar nano-structure of graphene oxide paper, and assembling at least a portion of the laminar nano-structure graphene oxide paper as a diaphragm of the acoustic transducer.

2. The method according to claim 1, further comprising thermally processing the graphene oxide paper, and at least one of:

metallizing a predetermined portion of the thermally processed graphene oxide paper;

crimping the thermally processed graphene oxide paper to generate a predetermined profile.

3. The method of claim 2 wherein said thermally processing includes adjusting the electrical characteristics of the graphene oxide paper.

4. The method according to claim 1, wherein the acoustic transducer is a magnetic induction based microphone.

5. The method according to claim 1, wherein the acoustic transducer is a diaphragm loudspeaker.

6. The method according to claim 1, further comprising shaping the deposited graphene oxide paper by mechanical distortion.

7. The method of claim 1, further comprising using the acoustic transducer within a magnetic induction based loudspeaker.

* * * * *